United States Patent [19]

Okunishi et al.

[11] Patent Number: 4,540,295

[45] Date of Patent: Sep. 10, 1985

[54] METHOD FOR CONTROLLING THE TEMPERATURE OF THE PRINTING HEAD OF AN IMPACT PRINTER

[75] Inventors: Mizuho Okunishi; Makoto Yasunaga, both of Tanashi, Japan

[73] Assignee: Citizen Watch Co., Ltd., Tokyo, Japan

[21] Appl. No.: 678,678

[22] Filed: Dec. 5, 1984

[30] Foreign Application Priority Data

Dec. 6, 1983 [JP] Japan ..... 58-229145

[51] Int. Cl.[3] ..... B41J 3/02

[52] U.S. Cl. ..... 400/120; 346/76 PH; 400/283; 219/216

[58] Field of Search ..... 101/93.01, 93.05, 93.04; 400/120, 283; 346/76 PH; 219/216 PH

[56] References Cited

U.S. PATENT DOCUMENTS

| | | | |
|---|---|---|---|
| 4,113,391 | 9/1978 | Minowa et al. | 400/120 |
| 4,389,935 | 6/1983 | Arai | 101/93.01 |
| 4,391,535 | 7/1983 | Palmer | 400/120 |
| 4,394,092 | 7/1983 | Osmera et al. | 400/120 |
| 4,407,003 | 9/1983 | Fukui | 346/76 PH |
| 4,420,758 | 12/1983 | Tabata et al. | 346/76 PH |

FOREIGN PATENT DOCUMENTS

| | | | |
|---|---|---|---|
| 153647 | 12/1979 | Japan | 400/120 |
| 136375 | 10/1981 | Japan | 400/120 |

*Primary Examiner*—E. H. Eickholt

*Attorney, Agent, or Firm*—Sherman & Shalloway

[57] ABSTRACT

A method for controlling the temperature of the printing head of an impact printer, capable of selectively changing the printing mode of the impact printer between the bidirection printing mode in which the printing head performs printing operation while it is moved in either of the reciprocating directions, the single direction printing mode in which the printing head performs printing operation while it is moved in one of the reciprocating directions and the idle reciprocation mode in which the printing head is merely reciprocated without performing printing operation, according to output signals of a low-level comparator which compares the measured temperature of the printing head with a low-level reference value and gives an alarm signal when the measured temperature is higher than the low-level reference value and a high-level comparator which compares the measured temperature with a high-level reference value and gives an alarm signal when the measured temperature is higher than the high-level reference value. The timing of changing the printing mode is controlled by timers to obviate unnecessary change of the printing mode so that the printing head is cooled appropriately and the printing capacity of the impact printer will not be reduced undesirably.

1 Claim, 6 Drawing Figures

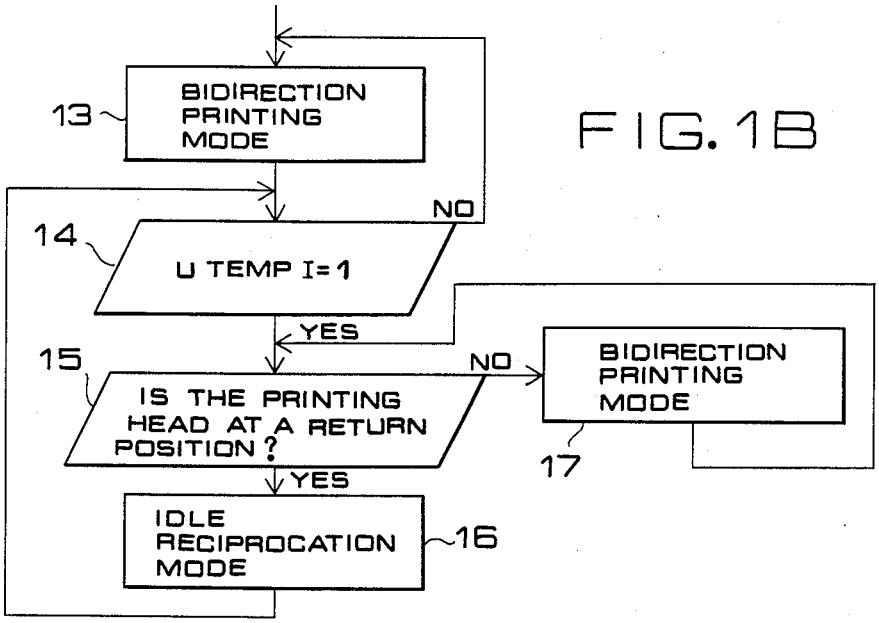
FIG. 1B
FIG. 2
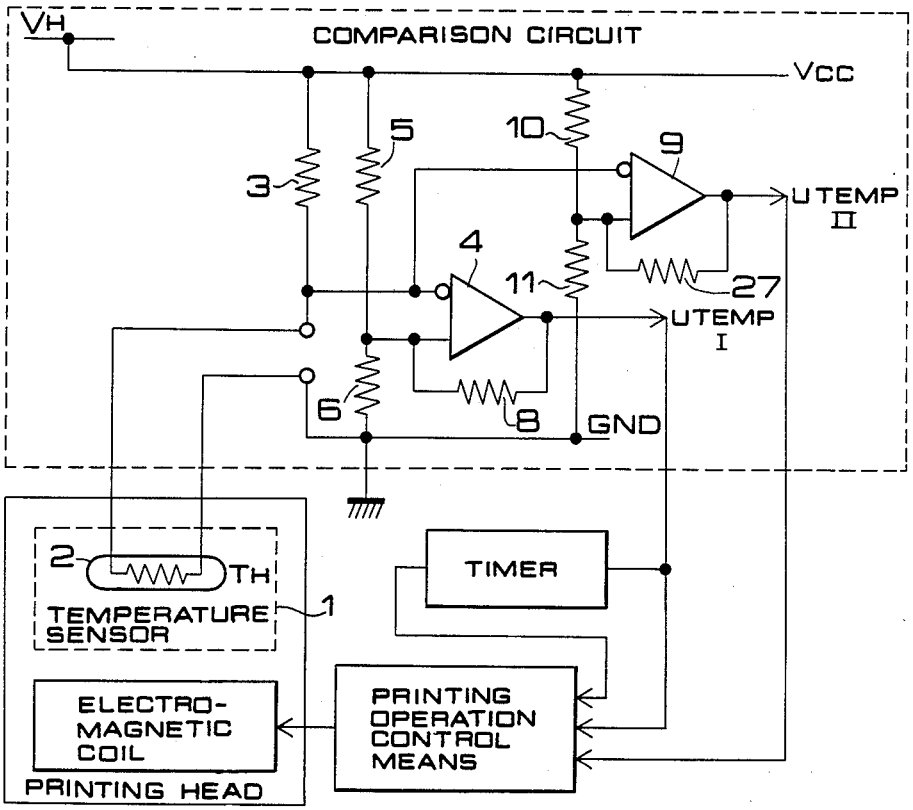

METHOD FOR CONTROLLING THE TEMPERATURE OF THE PRINTING HEAD OF AN IMPACT PRINTER

BACKGROUND OF THE INVENTION

1. Field of the Invention

The present invention relates to a method for controlling the temperature of the printing head of an impact printer.

2. Description of the Prior Art

An impact printer, such as a serial printer, which is employed as an output unit of an electronic computer or the like is designed generally to print with a printing head mounted on a carriage while the carriage is moved along the platen.

A printing head provided with a printing stylus unit is used often for such a printer to meet the necessity of printing Chinese letters, patterns and graphs.

Such a printing head is mounted on a carriage which is reciprocated in predetermined directions by a driving motor and the printing styluses are actuated continuously by supplying electric current to the corresponding electromagnetic coils for dot printing operation.

Heat is generated by the electromagnetic coils as the electromagnetic coils are energized and this heat tends to heat the printing head. As the electromagnetic coils are energized successively and frequently, the heat generated by the electromagnetic coils is accumulated at a rate exceeding the rate of heat radiation from the printing head, and thereby the printing head is heated up to an excessively high temperature. Consequently, the electrical insulation of the electromagnetic coils is deteriorated, short-circuit accident is likely to occur and the parts disposed around the electromagnetic coils tend to be burnt or subjected to thermal deterioration.

Such overheating of the printing head occurs when the printing head is operated at a high printing duty rate, such as in continuously printing English letters or katakana letters (Japanese syllabic letters) or in printing pictures or graphic representations.

A method to obviate the overheat of the printing head has previously been proposed, in which method the printing head is provided with a thermal sensor for detecting the temperature of the printing head and when abnormal rise in the temperature of the printing head is detected by the thermal sensor, the operation of the printing head is interrupted to allow the printing head to cool off. However, this method has a disadvantage that the frequent interruption of the printing operation of the printing head during continuous printing operation reduces the printing capacity of the printer.

Another method has been proposed to eliminate such a disadvantage of the prior method. According to this method, reduction in the printing capacity of the printer resulting from the frequent interruption of printing operation is limited to a small extent and the burning of the electromagnetic coils of the printing head is prevented by driving the printing head for printing operation only while the printing head is moved in one direction and interrupting the printing operation of the printing head while the printing head is moved in the opposite direction after the temperature of the printing head has reached an upper limit of temperature.

However, when the printing head is operated at a high printing duty rate (rate of printing cycles per unit time), excessive rise in the temperature of the printing head is possible even if the printing operation is performed only while the printing head is moved in one direction, and hence there is the possibility of the electromagnetic coils being burnt out.

SUMMARY OF THE INVENTION

The present invention has been made to eliminate those disadvantages of the prior art. Accordingly, it is an object of the present invention to provide a method for controlling the temperature of the printing head of an impact printer, which method is capable of preventing the burning of the parts of the printing head resulting from excessive rise in the temperature of the printing head and of reducing the duration of interruption of printing operation necessary for the cooling-off the printing head during continuous printing operation.

According to the present invention, there is provided a method of controlling the temperature of a printing head of an impact printer in which the printing head usually performs bidirectional printing operation by the steps of measuring the temperature of the printing head by a temperature sensor attached thereto, converting the measured temperature into a voltage corresponding thereto, transferring said measured voltage both to the input of a first comparator having a reference voltage and a hysteresis voltage and to the input of a second comparator having a reference voltage and a hysteresis voltage respectively higher than those of said first comparator, comparing the measured voltage with the reference voltage of said first comparator, when said measured voltage becomes higher than said reference voltage to actuate a timer, changing the bidirectional printing mode into a single direction printing mode in which the printing operation is done in only one of reciprocation of printing head when said printing head gets to a return position under actuated state of said timer by use of printing operation control means, comparing said measured voltage with the reference voltage of the second comparator at the termination of a time preset by said timer, changing the single direction printing mode into an idle printing mode in which the printing operation is not done and printing head is only reciprocated when said measured voltage is higher than the hysteresis voltage of said second comparator and said printing head gets to a return position by said printing operation control means, comparing the measured voltage with the hysteresis voltage of said first comparator, and changing said idle printing mode into the bidirectional printing mode when said measured voltage becomes lower then the hysteresis voltage of the first comparator and said printing head gets to a return position by said printing operation control means, whereby the temperature of printing head is regulated so as to prevent printing head from overheating and thereby the burning of the electromagnetic coils and significant reduction in the printing capacity of the printer are prevented.

The objects, features and advantages of the present invention will become apparent from the description of a preferred embodiments thereof taken in connection with the accompanying drawings.

BRIEF DESCRIPTION OF THE DRAWINGS

FIGS. 1A and 1B are flow charts of control routines embodying a method according to the present invention;

FIG. 2 is a circuit diagram of a temperature detecting circuit for carrying out the control routines of FIGS. 1A and 1B.

DETAILED DESCRIPTION OF THE PREFERRED EMBODIMENTS

Figure 1A:
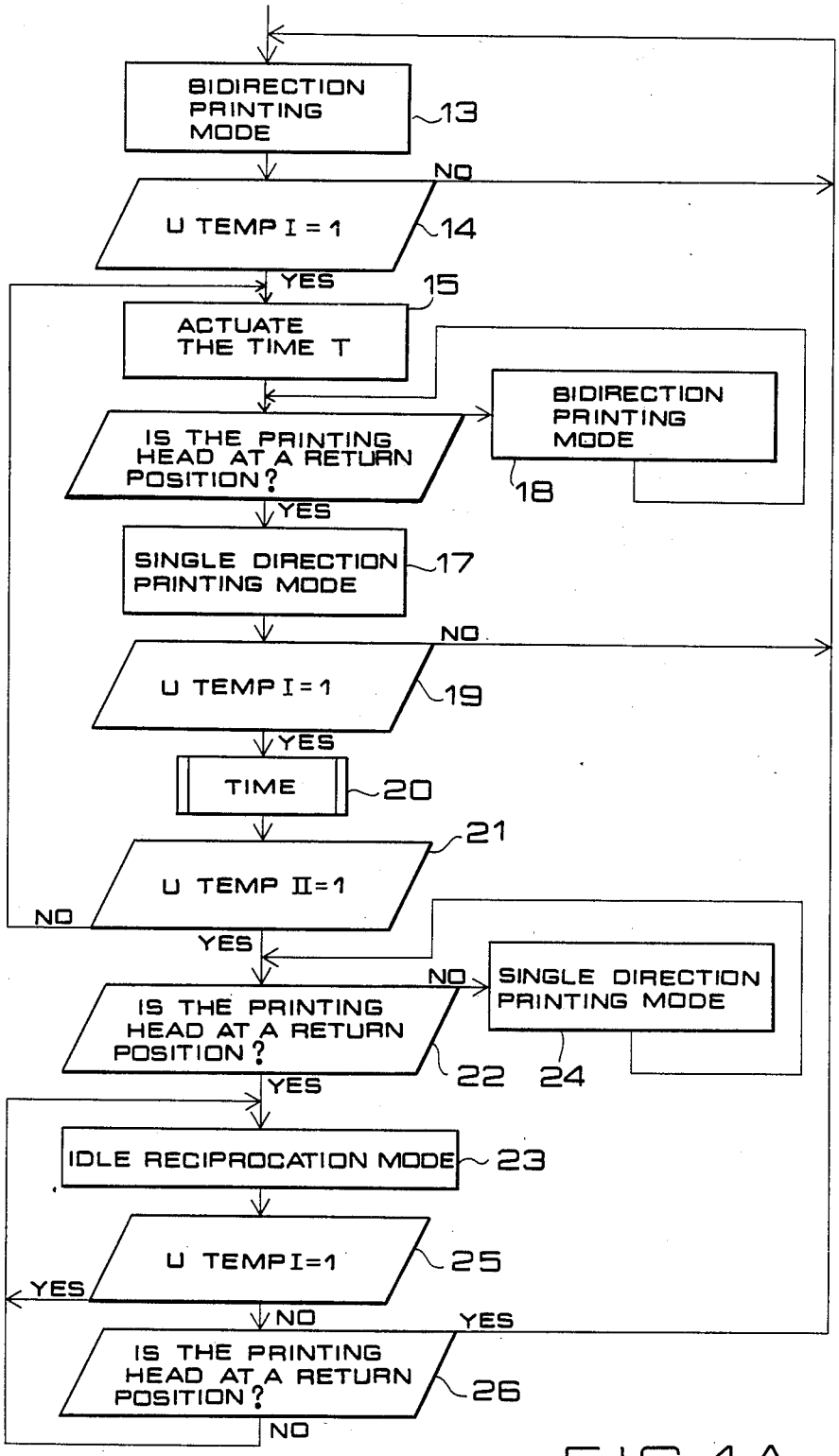

FIGS. 1A and 1B are flow charts of a method for controlling the temperature of the printing head of an impact serial dot printer which prints letters or the like by means of a dot matrix while the printing head is moved in predetermined directions. FIG. 2 is a circuit diagram of a temperature control circuit for carrying out the routines shown in FIGS. 1A and 1B.

Figure 3A:
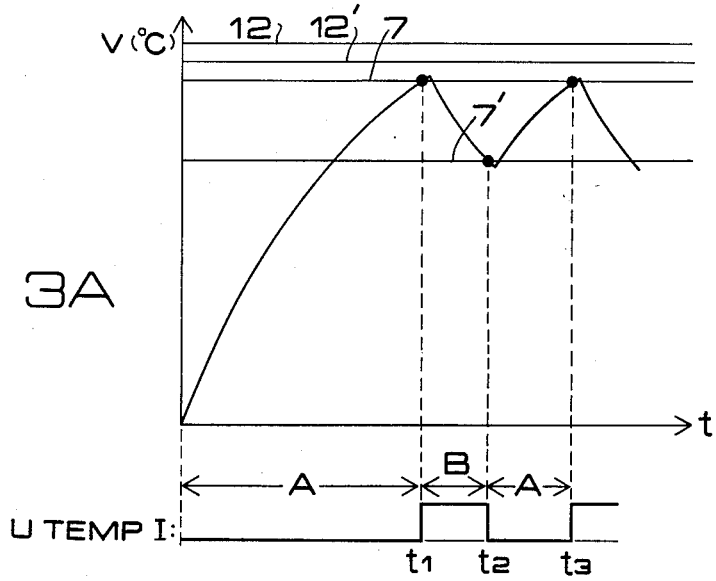
FIGS. 3A, 3B and 4 are diagrams showing the relations between the controlled temperature variation of the printing head and printing head operating modes.
Figure 3B:
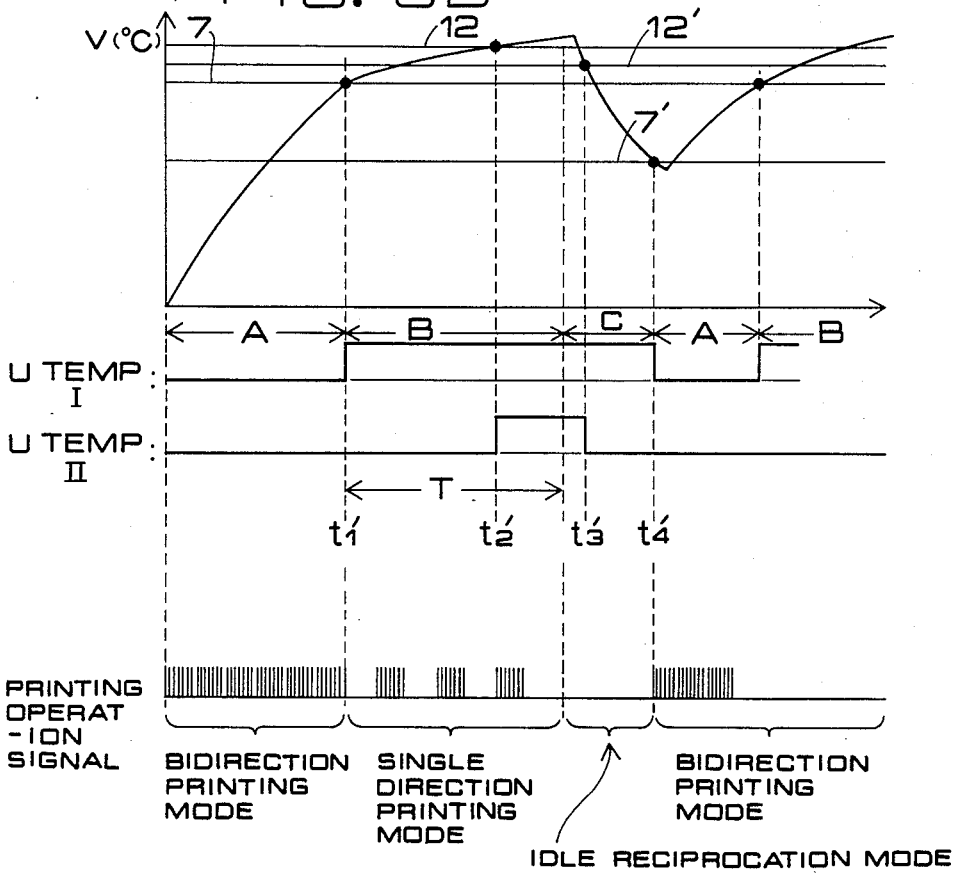
Figure 4:
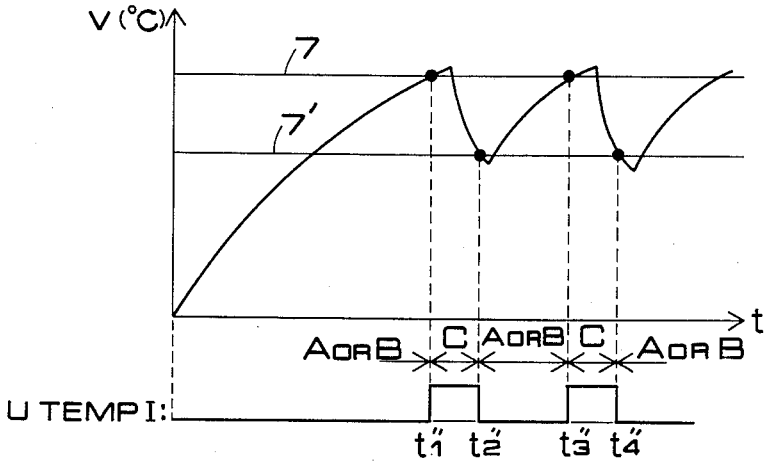

FIGS. 3A and 3B are diagrams showing the relations between the controlled temperature variation of the printing head and printing head operating modes according to the control routine of FIG. 1A in operating the printing head at a low printing duty rate and at a high printing duty rate respectively. FIG. 4 is a diagrams showing the relation between the controlled temperature variation and a printing head operating mode according to the control routine of FIG. 1B. The circuit diagram of FIG. 2 will be described prior to the description of the flow charts of FIGS. 1A and 1B representing the method for controlling the printing head of an impact printer.

A low-level detection circuit has a temperature sensor 2 attached to the printing head 1 and a low-level comparator 4. One terminal of the temperature sensor 2 is grounded while the other terminal of the same is connected through a resistance 3 to a reference value setting power source $V_H$ and to the inversion input terminal of the low-level comparator 4 to apply an output signal of the temperature sensor 2 to the low-level comparator 4. A voltage divided by resistances 5 and 6 is applied as a reference value to the noninversion terminal of the low-level comparator 4. When an abnormal temperature detection voltage exceeding a low-level reference voltage 7 determined by the reference value defined by the resistances 5 and 6 is provided, an alarm signal (UTEMP II) is given from the low-level reference terminal of the low-level comparator 4.

The low-level reference value is a voltage corresponding to a temperature by 1° C. to 5° C. lower than the temperature corresponding to the high level reference value. Upon the generation of the alarm signal, a command to stop the printing operation of the printing head 1 while the printing head 1 is moved in one of the directions of reciprocation, namely, to establish a single direction printing mode, and to actuate a timer.

A resistance 8 is connected to the low-level comparator 4 to provide the low-level detection circuit with a hysteretic characteristic so that the printing operation of the printing head while the printing head 1 is moved in both the directions of reciprocation (bidirection printing mode) is restarted after the temperature of the printing head has dropped sufficiently during the single direction printing mode.

A high-level detection circuit will be described hereinafter.

An input voltage is applied by the reference value setting power source through a resistance 3 to the inversion input terminal of a high-level comparator 9. A voltage divided by resistances 10 and 11 is applied as a reference value to the noninversion terminal of the high-level comparator 9. The reference value applied to the high-level comparator 9 is slightly greater than the reference value applied to the low-level comparator 4. If an abnormal temperature detection voltage which is greater than the high-level reference voltage defined by the resistances 10 and 11 at the completion of operation of the timer, an alarm signal UTEMP II is provided from a terminal 12. The high-level reference voltage is a voltage corresponding to a temperature which is neither unnecessarily low nor as high as to cause the burning of the electromagnetic coils of the printing head, preferably, a voltage corresponding to a temperature between 100° C. to 150° C.

When the alarm signal UTEMP II is given, the printing operation control means stops the printing operation of the printing head 1. Practically, the instant interruption of the printing operation of the printing head is undesirable from the view point of print data processing procedure depending on the contents of the print data being printed or the position of the printing head, and hence it is preferable, as shown in the flow chart of FIG. 1, to interrupt the printing operation of the printing head at the end of a printing line or at a good place in the contents to leave off.

Since the printing head is reciprocated without performing printing operation, no heat is generated in the printing head and the printing head is cooled forcibly by air while the printing head is driven for idle reciprocation, so that the printing head is cooled to a lower temperature. A resistance 27 is connected to the high-level comparator 9 to provide the high-level detection circuit with a hysteretic characteristic so that the printing operation of the printing head is restarted after the temperature of the printing head has dropped sufficiently.

Further description will be made as to the above-mentioned control functions. When the alarm signal is given by the low-level detection circuit, the printing operation control means gives a command to change the printing mode into the single direction printing mode, in which the printing head is driven for printing operation only while the printing head is moved in one of the directions of reciprocation. Even in the single direction printing mode, the temperature of the printing head tends to rise and the extended duration of temperature rise can cause the electromagnetic coils to burn. Accordingly, after a predetermined period of time limited by the timer from a time when the alarm signal is given by the low-level detection circuit, the high-level detection circuit provides the alarm signal if the temperature of the printing head is higher than the high-level reference value which is slightly higher than the low-level reference value to reciprocate the printing head with the printing operation stopped entirely. The function of the timer will be described to the further detail. Since the difference between the high-level reference value and the low-level reference value is very small as mentioned above, if the timer is not provided and if the temperature of the temperature measuring part of the printing head rises at a comparatively high rate after the temperature of the printing head has exceeded the low-level reference value, the printing mode is changed from the single direction printing mode into the idle reciprocation mode (a mode in which the printing head is reciprocated with the printing operation stopped) in a very short period of time after the printing mode has been changed into the single direction printing mode, which reduces the printing capacity of the printer. Furthermore, it occurs that the temperature of the measuring position where the temperature sensor is disposed, continues to rise even after the temperature of the electromagnetic coils has started dropping, due to the delay in the temperature rise of the measuring position resulting from the positional difference between the measuring position and the electromagnetic coils. Consequently, the printing mode is changed from the single direction printing mode into the idle reciprocation mode immediately after the printing mode has been changed into the single direction printing mode even though the temperature of the heat generating part of the printing head has started dropping during operation in the single direction printing mode and it is not necessary to stop the printing operation of the printing head, if no timer is provided, which will reduce the printing capacity of the printer significantly.

To obviate the above-mentioned undesirable operation of the printing head, the timer is provided to control the timing of temperature measurement by the high-level detection circuit. The timer is set at a time which is longer than the time of delay in the temperature rise of the measuring position relative to the heat generating part and shorter than a time during which the electromagnetic coils of the printing head will never be burnt under a printing condition which will cause the sharpest temperature rise during the printing operation in the single direction printing mode. If the temperature of the printing head is higher than the high-level reference value at the end of the timing operation of the timer, the printing operation of the printing head is stopped. Therefore, unnecessary interruption of printing operation is obviated.

If the timer is omitted by expanding the difference between the high-level reference value and the low-level reference value as means to eliminate the influence of the time difference in temperature rise between the heat generating part and the temperature measuring position on the printing head, time for bidirection printing operation is reduced and the printing capacity of the printer is reduced, because the high-level reference value can not be raised any further, and hence the low-level reference value needs to be lowered.

The description of the temperature control procedure according to the flow charts of FIGS. 1A and 1B and the description of the temperature variation curves of FIGS. 3A, 3B and 4 will be made hereinafter.

The control routine of FIG. 1A is applied both to printing operation at a low printing duty rate as represented by FIG. 3A and to printing operation at a high printing duty rate as represented by FIG. 3B. In FIGS. 1A and 1B, numerals 13 to 26 designated steps of the control routine shown by the flow charts.

The controle routine of FIG. 1A and the diagram FIG. 3A of the temperature variation of the printing head in printing operation at a low printing duty rate will be described hereunder.

When the printing head is operated at a low printing duty rate, the printing head 1 of the impact printer is operated in the bidirection printing mode A at Step 13. At Step 14, decision is made if the temperature of the printing head 1 is above the UTEMP I 7 at a time $t_1$. If so, the alarm signal is provided to change the printing mode into the single direction printing mode B and the timer is actuated at Step 15. After the duration of the single direction printing mode B for a predeterimed time, the single direction printing mode B is cancelled by the agency of the hysteresis characteristic 7' at a time $t_2$ and the printing mode is changed to the bidirection printing mode A of Step 13. At a time $t_3$, Step 14 is executed again to decide if the temperature of the printing head is above the low-level reference voltage 7. If so, the printing mode is changed from the bidirection printing mode A into the single direction printing mode B. This control cycle is repeated. Although the timer is actuated at the time $t_1$, the UTEMP II 12 will not function, since the temperature of the printing head drops during the operation in the single direction printing mode A.

The control routine of FIG. 1A and the diagram FIG. 3 of the temperature variation of the printing head in printing operation at a high printing duty rate will be described hereunder. At Step 13 the printing head is operated in the bidirection printing mode, namely, the ordinary continuous printing mode. The temperature of the printing head rises gradually with time and exceeds the UTEMP I 7' at a time $t_1'$. Then at Step 14, the printing mode is changed into the single direction printing mode B and the timer T is actuated at Step 15. The temperature of the printing head keeps rising. Preferable control time of the timer T is approximately 30 seconds to 60 seconds. If the temperature of the printing head is higher than the high-level reference value 12 which is slightly higher than the low-level reference value 7 at Step 21, the printing mode is changed into the idle reciprocation mode C with the printing operation stopped. Thus, if the temperature of the printing head exceeds the high-level reference value 12 at the time $t_2$, printing operation stopping action is not performed until a predetermined time passes, because a printing operation signal stopping signal is given or the timer is effective. After the control time of the timer has elapsed, the temperature of the printing head drops and the hysteretic characteristic 12' of the high-level reference value 12 functions at a time $t_3'$ the idle reciprocation mode C is continued. Upon the drop of the temperature of the printing head to a lower temperature at a time $t_4'$, the hysteretic characteristic 7' of the low-level reference value 7 becomes effective, and thereby the printing mode is changed again to the bidirection printing mode A of Step 13 for continuous printing operation. In case decision is made at Step 25 that the temperature of the printing head is higher than the low-level reference value, the printing mode is changed again to the idle reciprocation mode at Step 23 so that the printing head is reciprocated with the printing operation stopped for cooling by air.

The flow chart of FIG. 1B and the temperature variation diagram of FIG. 4 will be described hereunder.

At Step 13, the printing head is operated in the bidirection printing mode A to continue bidirection printing operation. If the temperature of the printing head exceeds the low-level reference voltage 7 at a time $t_1''$, a signal to terminate the bidirection printing mode A is given and to interrupt the printing operation of the printing head immediately and the printing mode is changed into the idle reciprocation mode C at Step 16.

At a time $t_2''$, the printing mode is returned to the bidirection printing mode A at Step 13 by the effect of hysteresis voltage 7' of the reference voltage 7.

During a period between the time $t_3''$ and the time $t_4''$, the printing head is merely reciprocated without performing printing operation for forced cooling by air.

As has been described hereinbefore, according to the present invention, the low-level temperature detection circuit and the high-level temperature detection circuit compares the detected temperature of the printing head with the low-level reference voltage and the high-level reference voltage respectively, the printing operation control means gives a command to change the ordinary bidirection printing mode into the single direction printing mode when the low-level temperature detection circuit gives an alarm signal, and the printing operation control means gives a command to change the single direction printing mode into the idle reciprocation mode after a period of time defined by the timer from the time when the low-level temperature detection circuit gave the alarm signal so that the printing head is reciprocated without being driven for printing operation, for forced cooling by air. Thus the temperature of the printing head can be lowered to a predetermined temperature and the period of interruption of the printing operation of the printing head is reduced to the least necessary extent, and thereby reduction in the printing capacity of the impact printer and the burning of the electromagnetic coils of the printing head is obviated.

What is claimed is:

1. A method of controlling temperature of a printing head of an impact printer in which said printing head usually performs bidirectional printing operation, said method comprising the steps of:

(a) measuring the temperature of said printing head by a temperature sensor attached tereto;

(b) converting the measured temperature into a voltage corresponding thereto;

(c) transferring the measured voltage both to an input of a first comparator having a reference voltage and a hysteresis voltage and to an input of a second comparator having a reference voltage and a hysteresis voltage respectively higher than those of said first comparator;

(d) comparing the measured voltage with the reference voltage of said first comparator, when the measured voltage becomes higher than said reference voltage to actuate a timer;

(e) changing the bidirectional printing mode into a single direction printing mode in which the printing operation is done in only one of reciprocation of said printing head when said printing head gets to a return position under actuated state of said timer by making use of printing operation control means;

(f) comparing the measured voltage with the reference voltage of said second comparator at the termination of a time preset by said timer;

(g) changing the single direction printing mode into an idle printing mode in which the printing operation is not done and said printing head is only reciprocated when said measured voltage is higher than the hysteresis voltage of said second comparator and said printing head gets to a return position by said printing operation control means;

(h) comparing the measured voltage with the hysteresis voltage of said first comparator; and (i) changing the idle printing mode into the bidirectional printing mode when the measured voltage becomes lower than the hysteresis voltage of said first comparator and said printing head gets to a return position by said printing operation control means;

whereby the temperature of said printing head is regulated so as to prevent said printing head from overheating.

* * * * *